US008720737B2

(12) United States Patent
Raybuck et al.

(10) Patent No.: US 8,720,737 B2
(45) Date of Patent: May 13, 2014

(54) VARIABLE-DIAMETER STORAGE TANK SYSTEM

(71) Applicant: Global Fabrication, Inc., Dubois, PA (US)

(72) Inventors: Dennis Raybuck, Dubois, PA (US); Luke Sicard, II, Dubois, PA (US)

(73) Assignee: Global Fabrication, Inc., DuBois, PA (US)

( * ) Notice: Subject to any disclaimer, the term of this patent is extended or adjusted under 35 U.S.C. 154(b) by 0 days.

(21) Appl. No.: 13/834,875

(22) Filed: Mar. 15, 2013

(65) Prior Publication Data

US 2013/0327776 A1 Dec. 12, 2013

Related U.S. Application Data

(60) Provisional application No. 61/749,435, filed on Jan. 7, 2013, provisional application No. 61/658,225, filed on Jun. 11, 2012.

(51) Int. Cl.

| | |
|---|---|
| ***B65D 90/08*** | (2006.01) |
| ***B65D 6/28*** | (2006.01) |
| ***B65D 6/26*** | (2006.01) |

(52) U.S. Cl.

CPC *B65D 90/08* (2013.01); *B65D 7/32* (2013.01); *B65D 2501/24178* (2013.01)

USPC ..... 220/693; 220/692; 220/565; 220/4.17; 4/506

(58) Field of Classification Search

CPC ..... B65D 90/08; B65D 7/32; B65D 2501/24178; B65D 2501/24159; B65D 2501/24146

USPC ..... 220/693, 692, 682, 684, 683, 4.17, 220/4.16, 4.12, 4.13, 4.04, 4.08, 677, 565; 4/506

See application file for complete search history.

(56) References Cited

U.S. PATENT DOCUMENTS

| | | | | | |
|---|---|---|---|---|---|
| 191,406 | A | * | 5/1877 | Coleman | 220/4.26 |
| 312,875 | A | * | 2/1885 | Marshall | 220/4.17 |
| 1,494,818 | A | * | 5/1924 | Shean | 220/4.17 |
| 1,905,413 | A | * | 4/1933 | Kramer | 52/545 |
| 2,388,297 | A | * | 11/1945 | Slaughter | 428/53 |
| 2,914,149 | A | * | 11/1959 | Walker | 52/394 |
| 3,291,437 | A | * | 12/1966 | Bowden et al. | 249/48 |
| 3,448,554 | A | * | 6/1969 | Apesteguy | 52/461 |
| 3,951,294 | A | * | 4/1976 | Wilson | 220/4.31 |
| 4,060,945 | A | * | 12/1977 | Wilson | 52/169.5 |
| 2008/0197130 | A1 | * | 8/2008 | Volkmann | 220/4.26 |

* cited by examiner

*Primary Examiner* — Robert J Hicks

(74) *Attorney, Agent, or Firm* — Eckert Seamans Cherin & Mellott, LLC; David C. Jenkins

(57) ABSTRACT

A variable-diameter tank construction system is provided. The tank construction system uses sets of wedges (shims) and bevel-faced spacers (washers) in conjunction with the field connections of the vertical edges of adjacent modular tank wall panels, so as to create an angular deviation between the tangent lines of the wall panels immediately adjacent to and on either side of the vertical joint between the connected panels.

12 Claims, 7 Drawing Sheets

VARIABLE-DIAMETER STORAGE TANK SYSTEM

CROSS-REFERENCE TO RELATED APPLICATIONS

This application is related to U.S. Provisional Patent Application Ser. Nos. 61/658,225, filed Jun. 11, 2012, and 61/749,435, filed Jan. 7, 2013, the disclosures of which are incorporated herein in their entirety by reference.

FIELD OF THE DISCLOSURE

The present disclosure relates in general to modular storage tanks, and in particular to open-top modular storage tanks used in the petroleum industry. More particularly, the disclosure relates to systems and methods for constructing circular storage tanks of different diameters.

BACKGROUND

It is increasingly common in the oil and gas industry to use hydraulic fracturing (colloquially known as "fraccing" or "fracking") to aid in the recovery of petroleum fluids such as crude oil and natural gas from subsurface formations. Hydraulic fracturing is a process involving the injection of a "fraccing fluid" under pressure into spaces such as cracks and fissures within a subsurface petroleum-beating formation, such that the fluid pressure forces the cracks and fissures to become larger, and/or induces new fractures in the formation materials, resulting in more and/or larger flow paths through which petroleum fluids can flow out of the formation and into a well drilled into the formation. Fraccing fluids typically carry particulate materials called "proppants" that are intended to stay inside the enlarged or newly-created subterranean fissures after the fraccing fluid has been drained out of the formation and hydraulic pressure has been relieved.

There are various different types and formulations of fraccing fluids, but regardless of the type of fraccing fluid being used, one thing that is common to all fraccing operations is the need for temporary storage of very large volumes of fraccing fluid, both to provide a reservoir of frac fluid for injection into subsurface formations, and to store frac fluid circulated out of the well after completion of fraccing operations. Storage tanks having volumes of 250,000 to 1,500,000 U.S. gallons or more are commonly required for this purpose. For practical and environmental reasons, such tanks are typically of modular design so that their components can be shipped by truck to remote well sites, where they can be erected on site and eventually disassembled and shipped off site after they are no longer needed. The costs of shipping storage tank components to and from remote well sites and the costs of erecting and disassembling the tanks on site can be considerable. Accordingly, modular storage tank systems that minimize these costs are highly desirable.

Open-top storage tanks most commonly are circular, as this is the most stable and efficient structural configuration for a liquid storage tank. Modular circular tanks typically comprise multiple horizontally-curved steel wall panels having a radius corresponding to the radius (or half-diameter) of the finished tank. The vertical side edges of the curved wall panels abut and are fastened to the vertical edges of adjacent wall panels by suitable structural connection means, such that when all of the wall panels have been erected and interconnected, they form a circular tank having a particular height, diameter, and liquid storage capacity. External braces are typically installed at intervals around the perimeter of the tank to stabilize the panel assembly, and a suitable liquid-tight liner is installed inside the tank, covering a prepared around surface inside the tank perimeter and extending up and typically over the tank wall. The tank is then ready to receive a fraccing fluid or other liquid that needs to be stored.

Field connection of adjacent modular tank wall panels is commonly facilitated by fabricating the panels with continuous steel end plates or structural angles (a.k.a. angle irons) along their vertical side edges, such that the face of each end plate (or the face of one leg of each angle iron) lies in a plane coincident with a radius of the assembled tank, and perpendicular to the tangent line of the immediately adjacent region of the curved panel. Therefore, the faces of the end plates on adjacent panel edges will come into mating contact upon erection, such that the panels can be securely connected using structural bolts extending through bolt holes provided in the panels' vertical end plates or angle irons.

These field connections between adjacent tank wall panels must carry tensile forces induced by hoop stresses in the walls of the completed tank due to hydrostatic forces exerted by the liquid stored in the tank. The magnitude of the hoop stresses in the tank wall is proportionate to the density of the stored liquid, and it increases linearly with the depth of liquid in the tank. Accordingly, the tensile force that needs to be transferred across the vertical joints between adjacent tank wall panels, per unit of vertical distance, will increase linearly toward the bottom of the tank. The most efficient and economical structural design will therefore result in the bolt spacing in the panel end plates (or angle irons) being increasingly closer toward the bottom of the tank wall.

Alternatively, the bolt hole spacing could conceivably be kept constant by using different sizes of structural bolts at different locations. This alternative would require stocks of different sizes of bolts and would give rise to the risk that bolts that are too small might inadvertently be used in lower regions of the tank, potentially leading to catastrophic failure of the panel connections. However, it could be workable subject to appropriate quality control and field inspection during tank construction.

Modular circular storage tanks as described above are typically designed and fabricated with tank wall panels intended to be tank-diameter-specific. In other words, for a given finished tank diameter, the wall panels will have a radius of curvature corresponding to one-half the tank diameter. Accordingly, in order to accommodate different tank volume requirements, it is necessary to provide multiple sets of tank wall panels having different radii of curvature. This increases the overall cost of maintaining a stock of modular tank assemblies sufficient to meet anticipated requirements.

In addition, modular tanks with tank-diameter-specific wall panels can increase tank assembly transportation costs, such as when a tank of one size is used on one drilling site, and when the drilling rig is later moved to another well site (which might be comparatively close by) at which the frac fluid storage requirements are significantly less than or greater than at the first site. In that scenario, if the storage tank used at the first site has a capacity greater than required at the second site, it could be moved to and used at the second site to save transportation costs (as compared to transporting the tank away from the first site and shipping a smaller tank to the second site). However, that option is disadvantageous in that the larger tank is being inefficiently used, an unnecessarily large area on the well site needs to be prepared to erect the tank, and the tank erection and disassembly costs will be greater than if a smaller tank had been used.

In the alternative scenario where the tank storage capacity at the second site is greater than the requirement at the first site, there will be no alternative but to ship out the tank used at the first site and transport a larger tank to the second site.

For these reasons, there is a need for systems and methods for constructing modular storage tanks in which the modular wall panels can be used to construct tanks of different diameters. The present disclosure is directed to that need.

BRIEF SUMMARY

The present disclosure teaches a variable-diameter tank construction system using sets of wedges (shims) and bevel-faced spacers (washers) for use in conjunction with the field connections of the vertical edges of adjacent modular tank wall panels, so as to create an angular deviation between the tangent lines of the wall panels immediately adjacent to and on either side of the vertical joint between the connected panels. This allows the use of tank wall panels having a given radius of curvature to be used to construct substantially circular and structurally sound storage tanks having diameters either greater than or less than twice the panels' radius of curvature.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Figure 1:
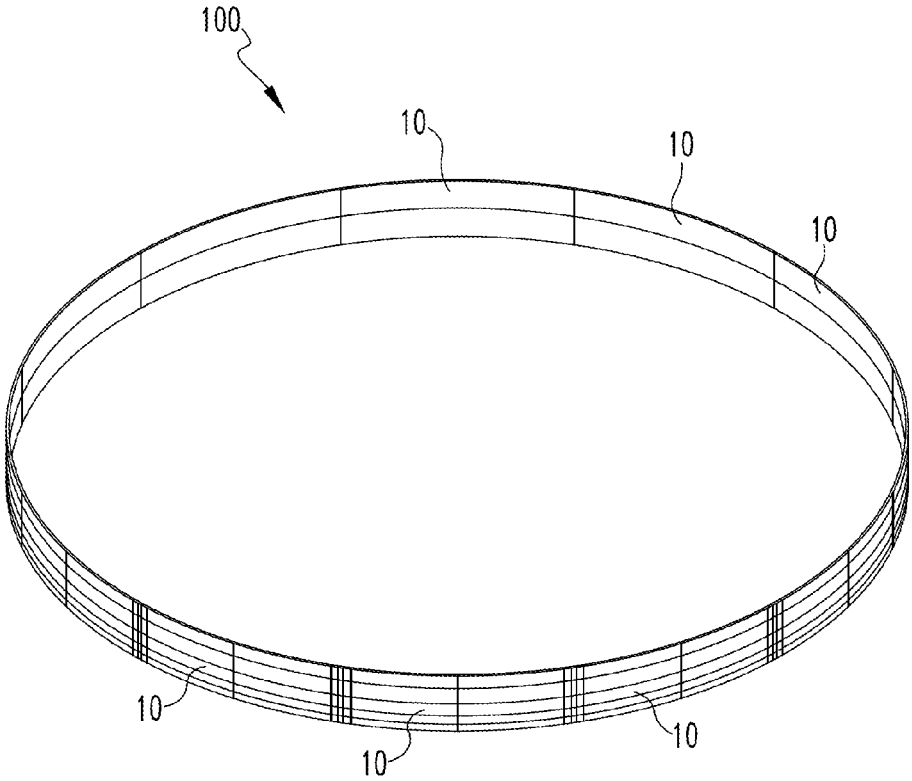
FIG. 1 is a perspective view of a plurality of prior art curved storage tank wall panels assembled to form the perimeter wall of a circular open-top storage tank.
Figure 2:
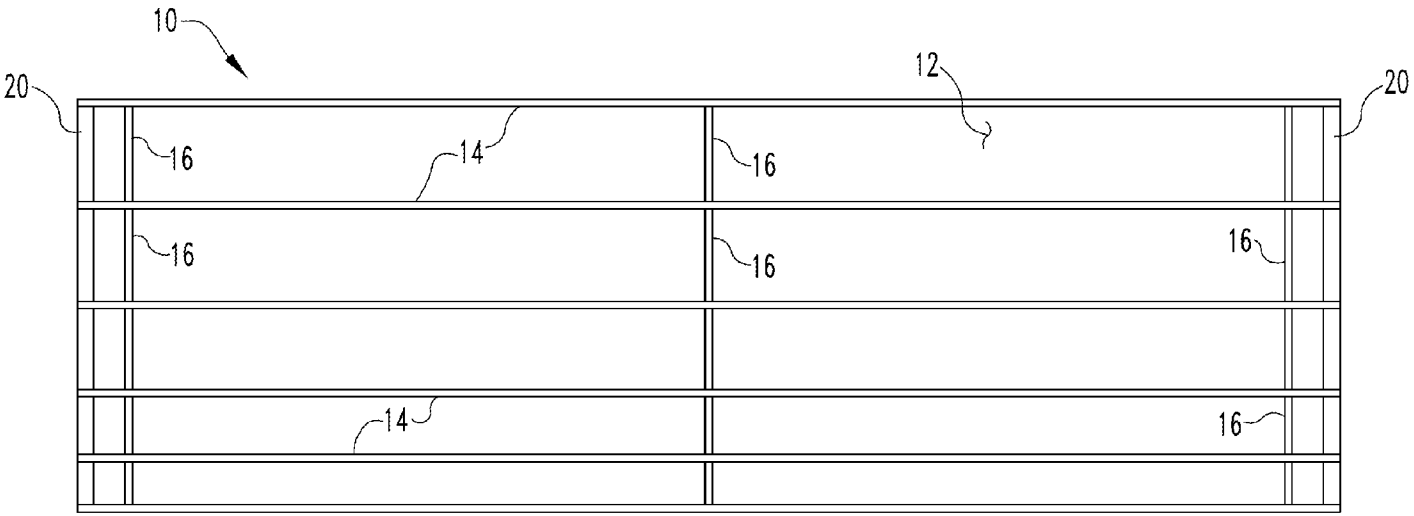
FIG. 2 is a side view of a typical storage tank wall panel as in FIG. 1.

FIG. 1 schematically illustrates a plurality of prior art curved tank wall panels 10 assembled to form an open-topped circular storage tank 100. FIG. 2 is an elevation view of an exemplary curved tank wall panel 10 comprising a horizontally-curved tank wall plate 12 reinforced by a plurality externally-mounted, horizontally-curved structural stiffeners 14, and with secondary vertical stiffeners 16 extending between vertically adjacent horizontal stiffeners 14. The spacing of horizontal stiffeners 14 becomes smaller toward the bottom of wall panel 10, thus reducing the vertical span of wall plate 12 in order to keep flexural stresses in wall plate 12 within safe limits as hydrostatic pressures exerted against wall plate 12 increase toward the bottom of wall panel 10. An angle iron side edge stiffener 20 is provided along each vertical side edge of wall panel 10.

Figure 3:
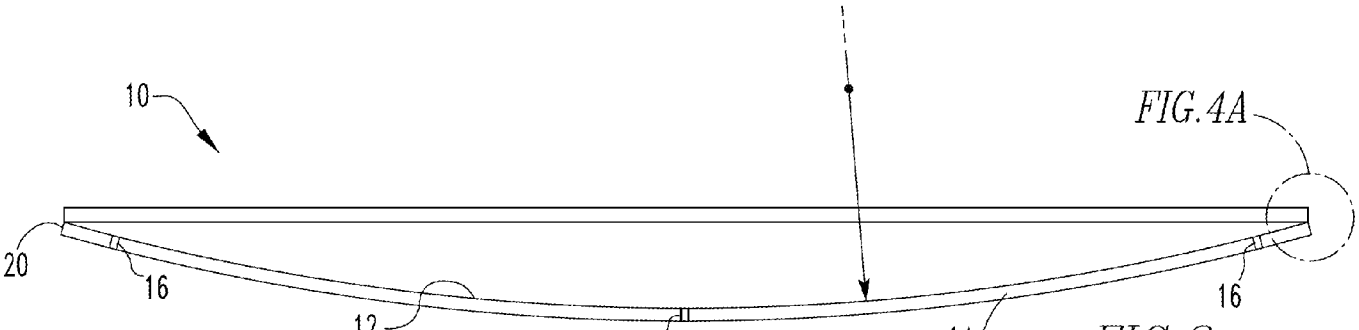
FIG. 3 is a top view of the tank wall panel in FIG. 2.

FIG. 3 is a top view of tank wall panel 10, illustrating the horizontal curvature of wall plate 12 and horizontal stiffeners 14. Although the dimensions of wall panel 10 and the tank ultimately constructed from wall panels 10 are variable to suit project-specific requirements, the particular wall panel 10 shown in FIGS. 2 and 3 is designed for purposes of a 12-foot-high storage tank having a nominal storage capacity of 750,000 U.S. gallons. As indicated in FIG. 3, this wall panel 10 has a chord length (i.e., the straight-line distance between vertical side edges) of approximately 26.7 feet. The dimensions of other variants of wall panel 10 would, of course, be different to suit different tank storage capacities and other design criteria.

Figure 4A:
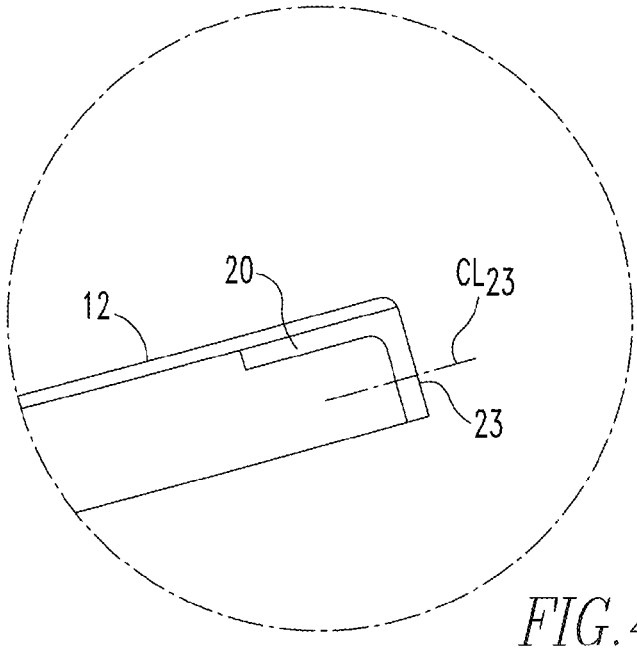
FIG. 4A is a plan cross-section through an angle iron welded to a vertical side edge of the tank wall panel in FIG. 3, with bolt holes to facilitate connection of the wall panel to an adjacent wall panel.
Figure 4B:
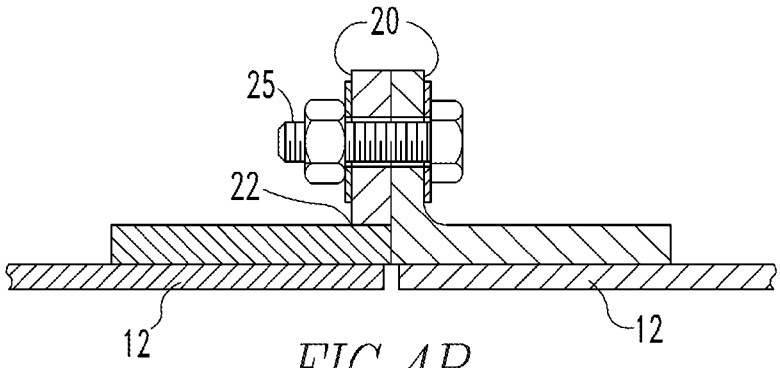
FIG. 4B is a plan cross-section through the bolted connection between the vertical side edges angles of adjacent tank wall panels as in FIG. 4A, in accordance with a prior art tank construction method.

FIG. 4A is an enlarged sectional detail of the welded connection of a side edge stiffener 20 to wall plate 12 and to intervening horizontal stiffeners 14 (the ends of which typically will be coped to fit around stiffener 20). Side edge stiffener 20 has a radially-aligned end face 22 (corresponding to one leg of the angle iron forming stiffener 20 in the illustrated embodiment) with suitably spaced bolt holes 23 having centerlines $CL_{23}$. FIG. 4B illustrates side edge stiffeners 20 of two adjacent wall panels 10, connected by means of bolts 25 passing through bolt holes 23 in stiffeners 20, with the end faces 22 of the two stiffeners 20 in mating contact.

Figure 5:
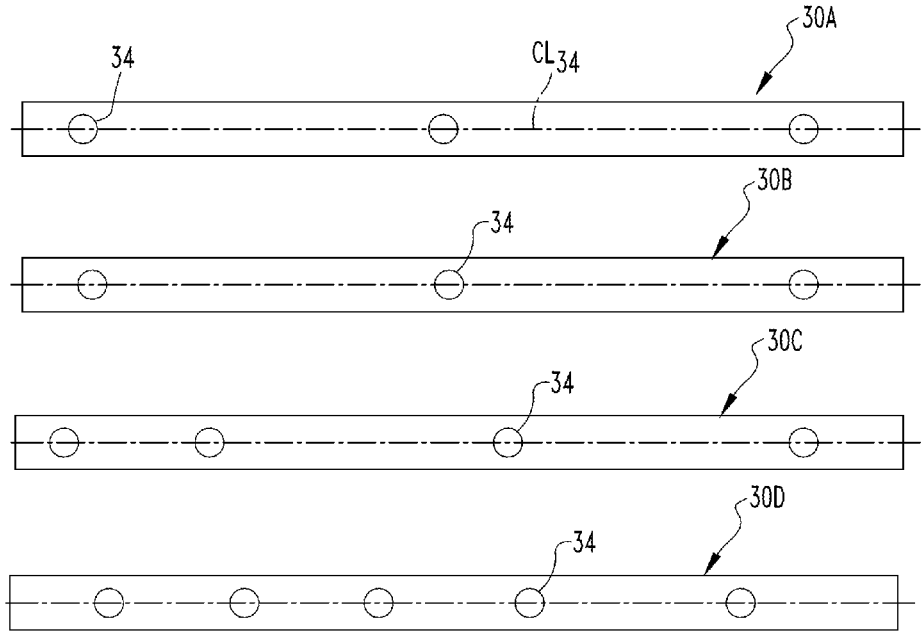
FIG. 5 is a side view of a set of wall panel adaptor wedges in accordance with the present disclosure, for adapting prior art curved storage tank wall panels for use in constructing a storage tank having a diameter less than double the wall panels' radius of curvature.
Figure 5A:
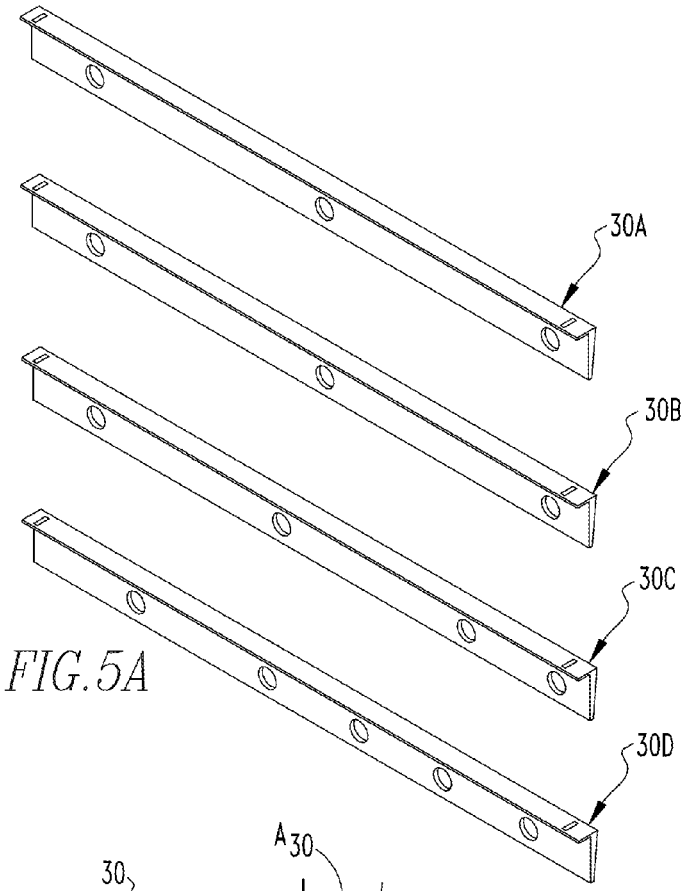
FIG. 5A is an isometric view of the set of wall panel adaptor wedges shown in FIG. 5.
Figure 6:
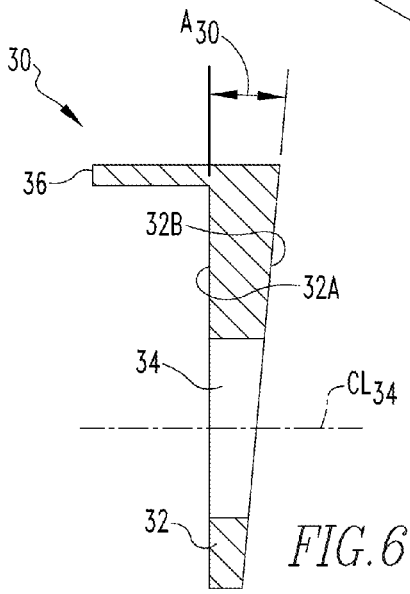
FIG. 6 is a cross-section through an exemplary wall panel adaptor wedge as in FIGS. 5 and 5A.

FIGS. 5, 5A, and 6 illustrate an exemplary set of elongate wall panel adaptor wedges 30 in accordance with the present disclosure, for installation between the end faces 22 of the side edge stiffener 20 of adjacent tank wall panels 10 (as will be explained in greater detail later herein). As best understood with reference to FIG. 6, each adaptor wedge 30 comprises a primary plate element (or leg) 32 having an orthogonal face 32A and a beveled face 32B, with orthogonal face 32A and beveled face 32B enclosing a wedge offset angle $A_{30}$. In the illustrated embodiment, wedge offset angle $A_{30}$ is 6 degrees, but this angle may vary from one embodiment to another. Primary leg 32 of adaptor wedge 30 has bolt holes 34 corresponding to bolt holes 23 in side edge stiffeners 20. The centerline $CL_{34}$ of bolt holes 34 is preferably perpendicular to orthogonal face 32A, as shown in FIG. 6.

Adaptor wedges 30 could be provided in single lengths corresponding to side edge stiffeners 20 (which are 12 feet long in the illustrated embodiment). As illustrated in FIGS. 5 and 5A, however, adaptor wedges 30 can be conveniently provided in sets of smaller lengths for ease of handling and installation. Because the spacing of bolt holes 23 typically varies along the length of side edge stiffeners 20, when adaptor wedges 30 are provided in smaller lengths, the spacings of bolt holes 34 in the wedges' respective primary legs 32 will vary within each set of wedges 30. This is reflected in FIGS. 5 and 5A, in which the illustrated wedges are designated by reference numbers 30A, 30B, 30C, and 30D. In wedges 30A and 30B (which are identical in the illustrated set of wedges), the spacing of bolt holes 34 is greater than in wedges 30C and 30D. The spacing of bolt holes 34 in wedge 30C is greater than in wedge 30D, and in fact the spacing of bolt holes 34 in wedge 30D reduces toward one end.

Accordingly (and having regard to the explanation set out previously herein regarding the variable fastener spacing for connections between abutting side edge stiffeners 20), each wedge in each set of wedges would typically be intended for installation at a different vertical location along the length of a field connection between two abutting side edge stiffener 20. More specifically, considering the exemplary wedge set shown in FIGS. 5 and 5A, wedges 30A and 30B (having wider bolt hole spacings) would be used in upper regions of a side edge stiffener connection, wedge 30D would be used in a lower region of the connection, and wedge 30C would be used in an intermediate region. Since the spacing of the bolt holes 34 in each wedge will always match the spacing of particular bolt holes 23 in stiffeners 20, it will be virtually if not completely impossible to install the wedges incorrectly.

Due to the offset angle $A_{30}$ between orthogonal face 32A and beveled face 32B of primary leg 32 of each adaptor wedge 30, the installation of wedges 30 in each vertical field joint between tank wall panels 10 will create a corresponding angular offset between the tangent lines of adjacent curved wall panels 10. This will result in a reduced effective tank radius as measured at the field connections of assembled tank wall panels 10, and the "included angle" of each wall panel 10 will be increased. Accordingly, offset angle $A_{30}$ for a given set of adaptor wedges 30 can be selected such that for particular tank wall panels 10 having a particular radius of curvature R, requiring a quantity "X" of wall panels 10 to create a storage tank having a diameter D equal to 2R, a quantity of "X" minus 1 wall panels 10 (or, in the more general case, "X" minus "n" wall panels 10) could be used to construct a storage tank having a diameter less than 2R.

As illustrated in FIGS. 5A and 6, each adaptor wedge 30 is preferably of generally L-shaped configuration, with a secondary plate element (or leg) 36 oriented perpendicular to orthogonal face 32A. Secondary leg 36 is preferably located an appropriate distance from centerline $CL_{34}$ of bolt holes 34 in adaptor wedge 30 such that secondary leg 36 serves as a stop member abuttable against the toe of one side edge stiffener 20 in a field connection between two adjacent stiffeners 20, so as to align the centerlines $CL_{34}$ of bolt holes 34 in adaptor wedges 30 with the centerlines $CL_{23}$ of bolt holes 23 in the side edge stiffeners 20. Accordingly, accurate field positioning of adaptor wedges 30 will entail only vertical adjustment of the positions of adaptor wedges 30 relative to side edge stiffeners 20.

In theory at least, bolts 25 could be simply inserted through the bolt holes in abutting side edge stiffeners 20 and an adaptor wedge 30 installed between the stiffeners 20. If that is done, however, bolts 25 and their corresponding nuts will not seat properly against the side edge stiffeners 20 due to the angular offset between the stiffeners resulting from the installation of adaptor wedge 30. Tightening bolts 25 in this scenario would induce undesirable flexural stresses in the bolts, and while this could theoretically be tolerated by selecting bolts strong enough to withstand such flexural stresses in addition to intended axial tension stresses, this is not ideal or desirable. It is much more desirable and preferable for bolts 25 to be stressed in axial tension only, as would be the case when bolts 25 are tightened with end faces 22 of side edge stiffeners 20 in mating contact, as seen in the arrangement illustrated in FIG. 4B.

Figure 7:
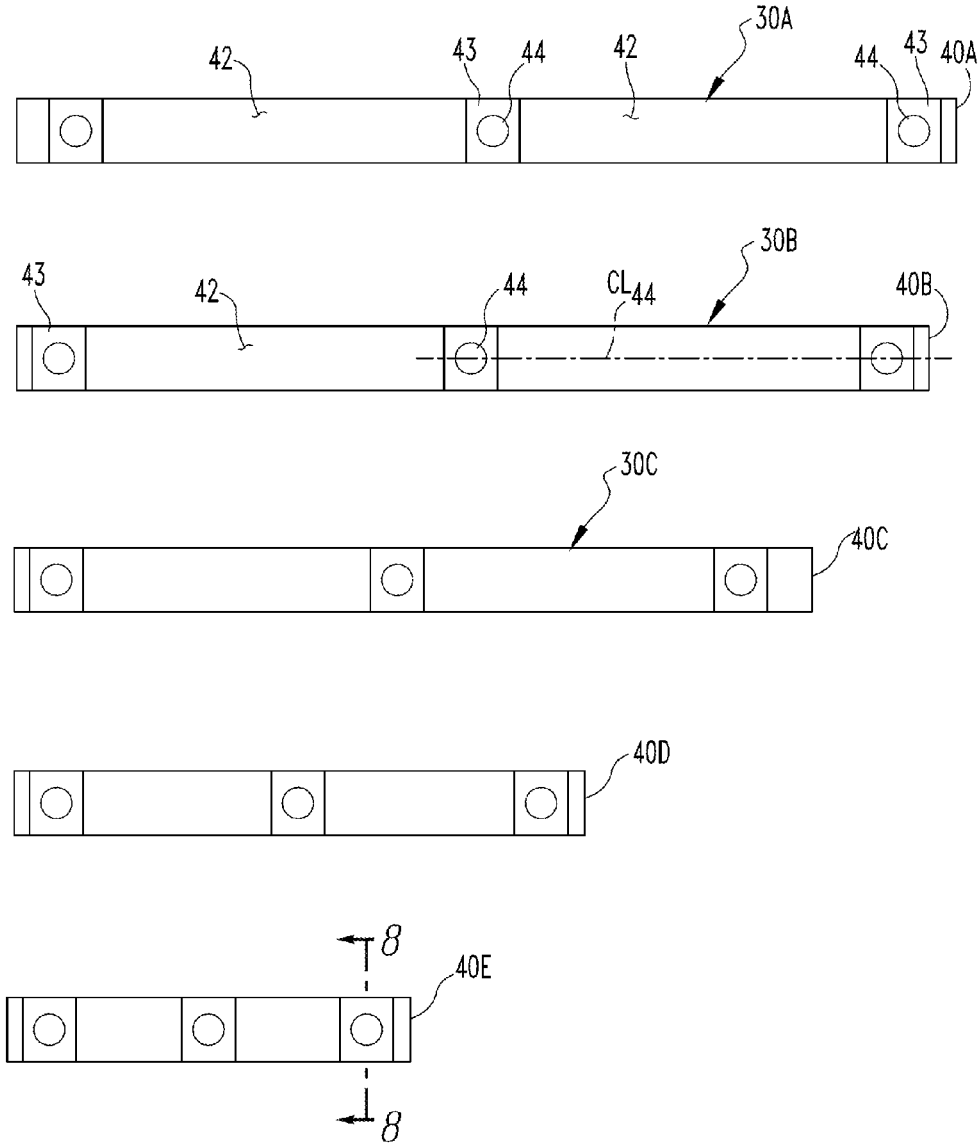
FIG. 7 is a side view of an exemplary set of spacer bars for use in conjunction with wall panel adaptors as in FIGS. 5 and 5A.
Figure 8:
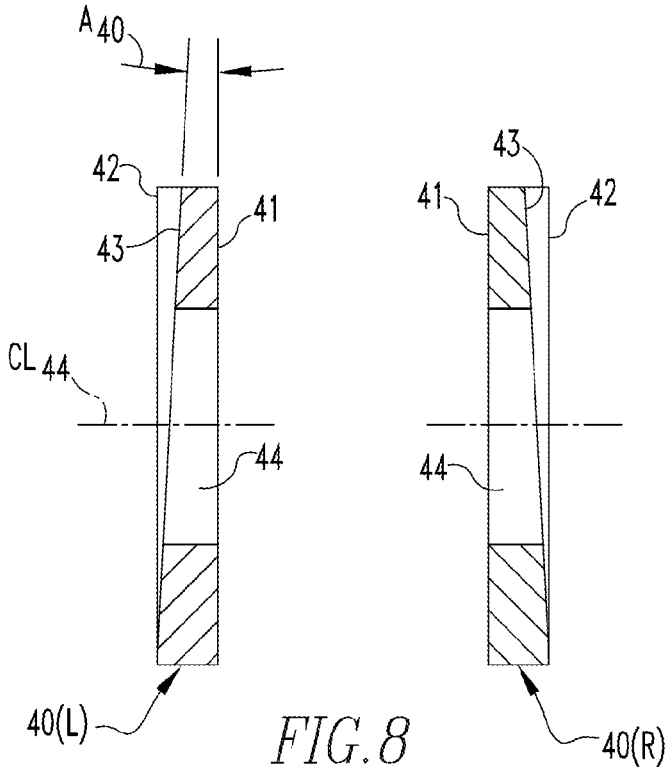
FIG. 8 is a cross-section through left-hand and right-hand variants of the spacer bars in FIG. 7.

Accordingly, adaptor wedges 30 as taught in the present disclosure are preferably used in conjunction with elongate spacer bars 40 as illustrated in FIGS. 7 and 8. Spacer bars 40 have bolt holes 42 spaced to match the spacing of bolt holes 23 in side edge stiffeners 20 and bolt holes 34 in adaptor wedges 30. As shown in FIGS. 7 and 8, each spacer bar 40 has a first (or inner) surface 41 and a second (or outer) surface 44. Outer surface 44 is machined or otherwise formed to provide bevelled surfaces 43 surrounding bolt holes 42, bevelled surfaces 43 being angularly offset from the plane of inner surface 41 by an offset angle $A_{40}$, with offset angle $A_{40}$ being equal to one-half of the offset angle $A_{30}$ of the associated adaptor wedges 30. When a spacer bar 40 is positioned against the outer face of each side edge stiffener 20 in a wall panel connection including adaptor wedges 30, the bevelled surfaces 43 of the spacer bars 40 on each side of the connection will be parallel to each other. Therefore, when bolts 25 are installed in this connection assembly, their bolt heads and nuts will bear uniformly against the bevelled surfaces 43 of the corresponding spacer bars 40, such that when bolts 25 are fully torqued they will for all practical purposes be under axial tension only.

Similar to the case of adaptor wedges 30, the spacings of bolt holes 42 in spacer bars 40 will vary in accordance with the variable spacing of bolt holes 23 in side edge stiffeners 20. A single elongate spacer bar 40 could be provided on each side of each tank wall panel connection, with bolt holes 42 spaced to match all bolt holes 23 in side edge stiffeners 20. Alternatively, however, a set of shorter spacer bars (indicated by reference numbers 40A, 40B, 40C, 40D, and 40E in FIG. 7) may be provided for convenient handling and installation instead of full-length spacer bars. If shorter spacer bars (40A, 40B, etc.) are provided, they can be interchangeable for use on either side of a tank wall panel connection if they have symmetrical bolt hole patterns (as in the exemplary spacer bars shown in FIG. 7). However, if full-length spacer bars 40 are provided, or if shorter spacers bars with non-symmetrical bolt hole patterns are provided, these will have to be provided in left-hand and right-hand variants, as indicated by reference number 40(L) and 40(R) in FIGS. 8 and 9.

In an unillustrated alternative embodiment, individual bevel washers could be used at each bolt location instead of elongate spacer bars 40.

Figure 9:
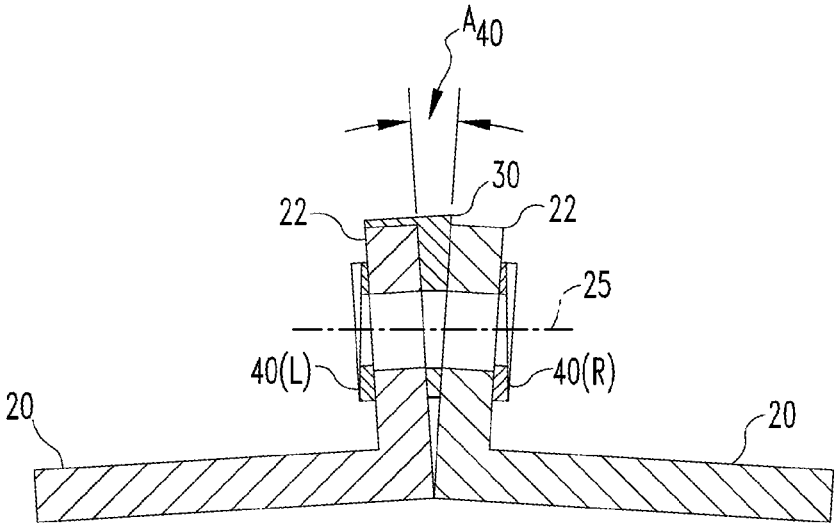
FIG. 9 is a plan cross-section through the bolted connection of the vertical side edges angles of adjacent tank wall panels using adaptor wedges as in FIGS. 5 and 5A in conjunction with left-hand and right-hand spacer bars as in FIGS. 7 and 8.

As previously described, the connection detail shown in FIG. 9, using adaptor wedges 30, allows storage tank wall panels 10 having a given radius of curvature to be used to construct a storage tank having a nominal diameter less than twice the panels' radius of curvature. In another unillustrated alternative embodiment, adaptor wedges generally similar to those previously described (with or without secondary legs) could be installed between adjacent side edge stiffeners 20 in an orientation reversed from the orientation of adaptor wedges 30 in the connection detail in FIG. 9, in order to allow storage tank wall panels 10 having a given radius of curvature to be used to construct a storage tank having a nominal diameter equal to greater than twice the panels' radius of curvature. In other words, the thicker portion of the wedges in this variant embodiment would be oriented toward the inside of the tank, such that the wedges spread the radially inner edges of the adjacent side edge stiffeners 20 apart from each other (instead of abutting each other as in FIG. 9), and with the offset angle $A_{30}$ between end the end faces 22 of the stiffeners being divergent toward the inside of the tank instead of the opposite case illustrated in FIG. 9. Therefore, by way of non-limiting example, if a total of 12 tank wall panels 10 having a radius of curvature R would be required to construct a storage tank having a uniform diameter equal to 2R, the storage volume of the tank could be increased by approximately 17 percent by using "reverse" adaptor wedges having a suitable bevel angle to allow the inclusion of one additional wall panel 10.

It will be readily appreciated by those skilled in the art that various modifications to embodiments in accordance with the present disclosure may be devised without departing from the scope of the present teachings, including modifications using equivalent structures or materials hereafter conceived or developed. It is to be especially understood that the scope of the present disclosure is not intended to be limited to described or illustrated embodiments, and that the substitution of a variant of a described or claimed element or feature, without any substantial resultant change in functionality, will not constitute a departure from the scope of the disclosure.

In this patent document, any form of the word "comprise" is to be understood in its non-limiting sense to mean that any item following such word is included, but items not specifically mentioned are not excluded. A reference to an element by the indefinite article "a" does not exclude the possibility that more than one such element is present, unless the context clearly requires that there be one and only one such element.

As used herein, relational terms such as "perpendicular", "vertical", and "coincident" are not intended to denote or require mathematical or geometric precision. Accordingly, such terms are to be understood in a general rather than precise sense (e.g., "generally perpendicular" or "substantially perpendicular") unless the context clearly requires otherwise.

Wherever used in this document, the terms "typical" and "typically" are to be understood in the sense of representative or common usage or practice, and are not to be understood as implying invariability or essentiality.

What is claimed is:

1. A wall panel adaptor wedge for a storage tank, said storage tank including a number of curved tank wall panels, each tank wall panel including an angle iron side edge stiffener along each vertical side edge of said wall panel, said adaptor wedge comprising:

a primary plate element including an orthogonal face and a beveled face; and said orthogonal face and said beveled face defining a wedge offset angle.

2. The adaptor wedge of claim 1 wherein said side edge stiffener includes spaced bolt holes and wherein said primary plate element includes a number of bolt holes corresponding to said side edge stiffener bolt holes.

3. The adaptor wedge of claim 2 wherein:

said primary plate element is disposed between two side edge stiffeners; and wherein bolts extend through said side edge stiffener bolt holes and said primary plate element bolt holes.

4. The adaptor wedge of claim 1 further including a secondary plate element, said secondary plate element oriented perpendicular to said orthogonal face.

5. The adaptor wedge of claim 4 wherein said secondary plate element is located at a distance from the centerline of adaptor wedge bolt holes such that said secondary plate element serves as a stop member abuttable against the side edge stiffener so as to align the centerlines of said adaptor wedge bolt holes with the centerlines of the side edge stiffener bolt holes.

6. A variable-diameter tank construction system for a storage tank, said tank including a number of curved tank wall panels, each tank wall panel including an angle iron side edge stiffener along each vertical side edge of said wall panel, said tank construction system comprising:

an adaptor wedge including a primary plate element;

said primary plate element including an orthogonal face and a beveled face;

said orthogonal face and said beveled face defining a wedge offset angle;

said primary plate element disposed between two adjacent side edge stiffeners;

a number of spacer bars, each spacer bar including a planar inner surface and a bevelled surface;

said spacer bevelled surface disposed at a spacer bar offset angle relative to said inner surface;

wherein said spacer bar offset angle is substantially equal to said wedge offset angle.

7. The tank construction system of claim 6 wherein:

the number of spacer bars is two; and wherein each said spacer bar offset angle is substantially equal to one half said wedge offset angle.

8. The tank construction system of claim 7 wherein said side edge stiffener includes spaced bolt holes and wherein:

said primary plate element includes a number of bolt holes corresponding to said side edge stiffener bolt holes; and each spacer bar includes a number of bolt holes corresponding to said side edge stiffener bolt holes.

9. The tank construction system of claim 8 wherein said bevelled surface is limited to the areas surrounding each spacer bar bolt hole.

10. The tank construction system of claim 8 wherein:

said primary plate element is disposed between two side edge stiffeners;

one spacer bar is disposed on the outer side of each side edge stiffener; and wherein bolts extend through said spacer bar boll holes, said side edge stiffener bolt holes and said primary plate element bolt holes.

11. The tank construction system of claim 8 wherein said adaptor wedge includes a secondary plate element, said secondary plate element oriented perpendicular to said orthogonal face.

12. The tank construction system of claim 11 wherein said adaptor wedge secondary plate element is located at a distance from the centerline of adaptor wedge bolt holes such that adaptor wedge secondary plate element serves as a stop member abuttable against the side edge stiffener so as to align the centerlines of said adaptor wedge bolt holes with the centerlines of the side edge stiffener bolt holes.

* * * * *

UNITED STATES PATENT AND TRADEMARK OFFICE

CERTIFICATE OF CORRECTION

PATENT NO. : 8,720,737 B2
APPLICATION NO. : 13/834875
DATED : May 13, 2014
INVENTOR(S) : Dennis V. Raybuck et al.

It is certified that error appears in the above-identified patent and that said Letters Patent is hereby corrected as shown below:

In The Specification
Column 1, line 28, “beating” should read --bearing--.
Column 2, line 2, “around” should read --ground--.
Column 3, line 40, “edges” should read --edge--.
Column 3, line 58, “edges” should read --edge--.
Column 5, line 6, “stiffener” should read --stiffeners--.
Column 6, line 56, “end the end” should read --the end--.

Signed and Sealed this
Twenty-fourth Day of May, 2016

Michelle K. Lee

Michelle K. Lee
*Director of the United States Patent and Trademark Office*